US012343584B2

(12) United States Patent
Patrick

(10) Patent No.: US 12,343,584 B2
(45) Date of Patent: Jul. 1, 2025

(54) WAIST MOUNTED SLED STRAP

(71) Applicant: Knees Over Toes, LLC, Clearwater, FL (US)

(72) Inventor: Ben Patrick, Clearwater, FL (US)

(73) Assignee: KNEES OVER TOES, LLC, Clearwater, FL (US)

( * ) Notice: Subject to any disclaimer, the term of this patent is extended or adjusted under 35 U.S.C. 154(b) by 163 days.

(21) Appl. No.: 17/746,425

(22) Filed: May 17, 2022

(65) Prior Publication Data

US 2023/0372761 A1 Nov. 23, 2023

(51) Int. Cl.
*A63B 21/065* (2006.01)
*A63B 21/00* (2006.01)

(52) U.S. Cl.
CPC ..... *A63B 21/065* (2013.01); *A63B 21/4009* (2015.10); *A63B 2214/00* (2020.08)

(58) Field of Classification Search
CPC ..... A63B 21/0004; A63B 21/0442; A63B 21/065; A63B 21/4009; A63B 22/20
See application file for complete search history.

(56) References Cited

U.S. PATENT DOCUMENTS

| | | | | |
|---|---|---|---|---|
| 11,406,863 | B2 * | 8/2022 | Bonyai | A63B 21/4017 |
| 2015/0126344 | A1 * | 5/2015 | Wehrell | A63B 21/0552 482/128 |
| 2023/0398405 | A1 * | 12/2023 | Woo | A63B 21/0552 |

OTHER PUBLICATIONS

Spud Inc, Econo Sled Strap, Published Dec. 2, 2021. Retrieved from the Internet <URL: https://web.archive.org/web/20211202033624/https://www.spud-inc-straps.com/product/econo-sled-strap/ > (Year: 2021).*

Spud Inc, Sled Belt, Published Jan. 8, 2012. Retrieved from the Internet <URL: https://www.youtube.com/watch?v=jH0fuzJcR10&t=1s> (Year: 2012).*

Testify Strength & Conditioning, DIY Sled Harness Option, YouTube, https://www.youtube.com/watchv=4Mjwf718hSU, Jul. 13, 2020.

* cited by examiner

*Primary Examiner* — Zachary T Moore
(74) *Attorney, Agent, or Firm* — Intelink Law Group, P.C.; Brad Bertoglio

(57) ABSTRACT

Disclosed is a waist mounted sled strap for resistance training. The waist mounted sled strap comprising a single length of webbing material (such as nylon webbing) arranged as a strap and a carabiner physically connected to the strap. The strap has a first end and a second end and the first end has a first opening. The second end is passed through the first opening to form the single belt loop and the single belt loop is configured to wrap around the waist of a user and position the first opening in a position along the waist of the user that allows the user to pull the sled. The carabiner is physically connected to the strap at the second end of the strap, where the carabiner is configured to be physically connected to a sled.

7 Claims, 6 Drawing Sheets

WAIST MOUNTED SLED STRAP

BACKGROUND

1. Field

The present disclosure relates in general to systems and methods for resistance training, and more specifically, to system and methods for resistance training by dragging weights.

2. Related Art

At present dragging weights on sleds is a popular way of building physical body strength by users working out. Typically this type of work out requires multiple elements to be utilized by a user, including a sled, weight, and straps for pulling the sled.

At present, the straps utilized to pull sleds for this purpose include either multiple straps that generally must be manually held by the user (usually with shoulder straps) or multiple straps that hook together to be utilized around the user's waist or shoulders. This approach can be cumbersome and requires lots of parts that need to be attached together, and carefully monitored so that they are not lost. Additionally, these known approaches may limit a user's ability to isolate certain muscle groups of the hips and legs. These known approaches may also require significant time in setting up before a user can start to use them for a workout, and/or configuration training for novice users. As such, there is a need for a system and method that addresses some or all of these issues.

SUMMARY

Disclosed is a waist mounted sled strap for resistance training. The waist mounted sled strap comprising a single length of nylon webbing material arranged as a strap and a carabiner physically connected to the strap. The strap has a first end and a second end and the first end has a first opening. The second end is passed through the first opening to form a single loop and the single loop is configured to wrap around the waist of a user as a belt loop, and position the first opening in a position along the waist of the user that allows the user to pull the sled. The carabiner is physically connected to the strap at the second end of the strap, where the carabiner is configured to be physically connected to the sled.

In an example of operation, the waist mounted sled strap may be utilized to perform a method that comprises wrapping the waist mounted sled strap around the waist of a user, positioning the first opening in a position along the waist of the user that allows the user to pull the sled, attaching the carabiner to the sled, and pulling the sled with the waist mounted sled strap.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

A waist mounted sled strap for resistance training is disclosed. The waist mounted sled strap includes a single length of nylon webbing material arranged as a strap and a carabiner, wherein the carabiner is configured to be physically connected to the strap and, while in use, a sled. The strap has a first end and a second end and means for passing the second end through the first end to form a single belt loop. The single belt loop can be wrapped around a user, and positioned along the waist of the user to allow the user to pull the sled with the strap—potentially without encumbering the user's hands, allowing free arm motion to facilitate balance and dynamic walking motions.

Figure 1:
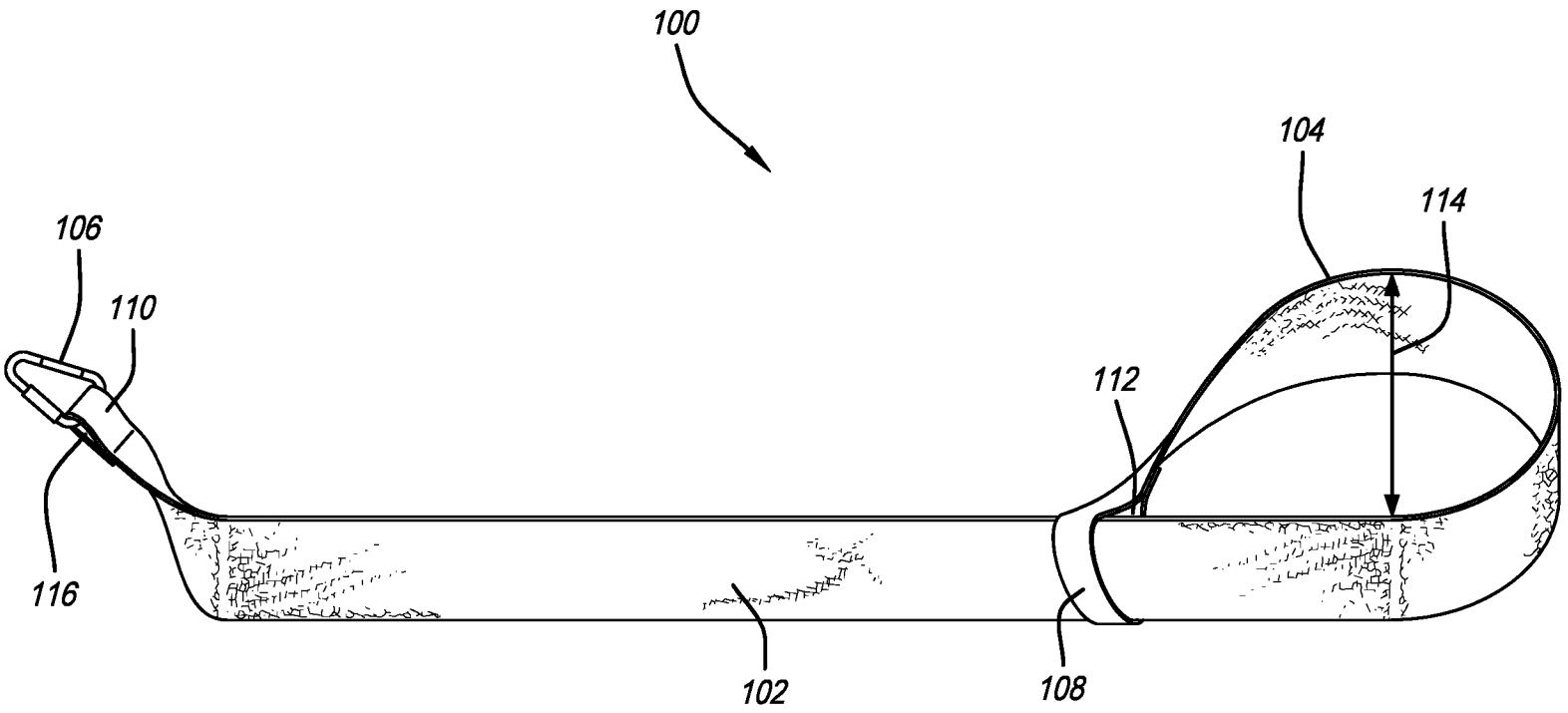
FIG. 1 is a system diagram of an example of an implementation of a waist mounted sled strap in accordance with the present disclosure.

In FIG. 1, a system diagram is shown of an example of an implementation of the waist mounted sled strap 100 in accordance with the present disclosure. The waist mounted sled strap 100 includes a single strap 102. Preferably, strap 102 is formed from a single length of nylon webbing material, although it is contemplated and understood that alternative materials can be utilized in other embodiments.

Sled strap 100 further includes carabiner 106 physically connected to a second end 110 of strap 102, with the carabiner 106 also configured to be physically connected to a sled (not shown) thereby attaching strap 102 to the sled. While certain illustrated embodiments describe use of carabiner 106 as an attachment mechanism to attach sled strap 100 to a sled, it is contemplated and understood that in other embodiments, alternative attachment mechanisms could be utilized. For example, in some embodiments, a clip, hook, knotted strap, shackle, soft shackle, or other attachment structure could be utilized to attach sled strap 100 to a sled.

In this example, strap 102 has a first end 108 and a second end 110 and a means for passing the second end 110 through the first end 108 to form a belt loop 104. Sled strap 100 also has a means for wrapping the belt loop 104 around the waist (not shown) of a user (not shown) and a means for positioning the strap 102 along the waist of the user that allows the user to pull the sled.

In this example, the first end 108 has a small looped end forming a first opening 112. The belt loop 104 has an inner diameter 114 and the means for wrapping the belt loop 104 around the waist of the user, including tightly wrapping around the waist of the user, by adjusting or otherwise locating the position of first opening 112 along strap 102 to adjust the inner diameter 114 of the belt loop 104. In particular, belt loop 104 can be tightened by pulling first end 108 along strap 102 in a direction away from second end 110, thereby reducing inner diameter 114 and securing belt loop 104 in a desired position on a user's waist during exercise. Additionally or alternatively, second end 110 can be pulled outwardly, away from first end 108 and first opening 112, to tighten belt loop 104 around a waist of the user. Once exercise is completed, belt loop 104 can be loosened by pulling first end 108 along strap 102 in a direction towards second end 110 to increase inner diameter 114.

Figure 2:
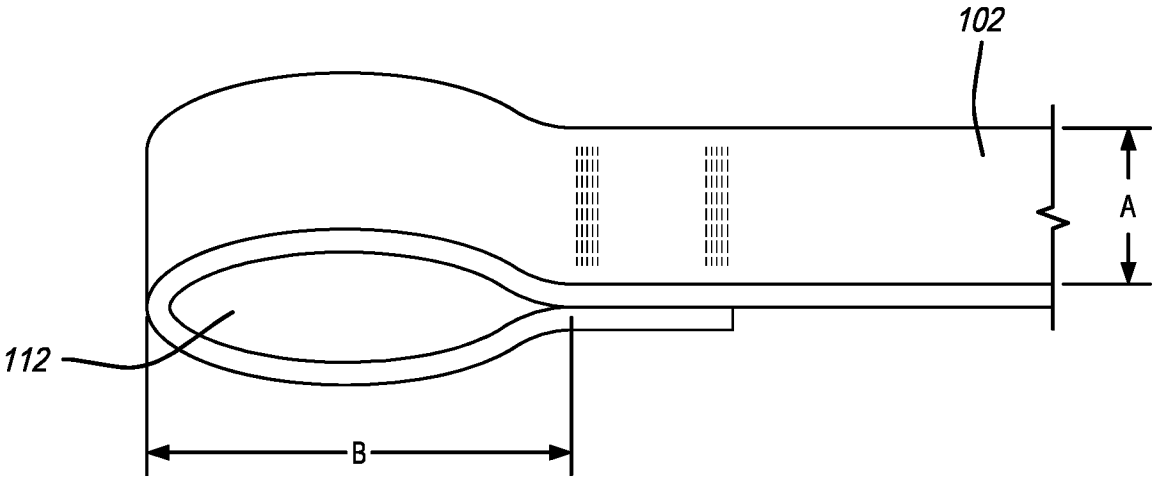
FIG. 2 is a partial perspective view of a first end of the waist-mounted sled strap.

Preferably, strap 102 is formed from a length of flat nylon webbing having a width that is slightly greater than the length of first opening 112, when first opening 112 is collapsed flat. FIG. 2 provides a closeup, partial cutaway view of such an embodiment. Strap 102 is formed from flat webbing having a width along dimension A of 4 inches. The webbing of strap 102 forms a loop at one end, forming first opening 112 with a length along dimension B of 3.5 inches. As a result, when belt loop 104 is wrapped around a user's waist and utilized to pull sled 204, the size of first opening 112 relative to strap 102 may inhibit or restrict movement of strap 102 through first opening 112, and accordingly control the extent to which belt loop 104 constricts around the waist of a user during use. In various contemplated embodiments, the ratio of first opening 112 length B to strap 102 width A may be, amongst other proportions: 100%, 90%, 80%, 75%, or 70%.

In some embodiments, the strap 102 has a length that is physically long enough to directly connect to a sled with the carabiner 106, and also form belt loop 104, while allowing the entire assembly to be easily stored as a single unit (e.g. in a carrying case) for ease of transportation and assembly.

In some embodiments, the first end 108 may be braided to increase the strength of the nylon material at the first opening 112 to provide tensile strength to withstand forces caused by pulling a sled with the portion of strap 102 that passes through the first opening 112. Similarly, the second end 110 may also be braided to increase the strength of the nylon material at the second opening 116 to provide improved tensile strength to withstand forces produced by pulling the sled with the carabiner 106 and second opening 116 at the second end 110.

Figure 3:
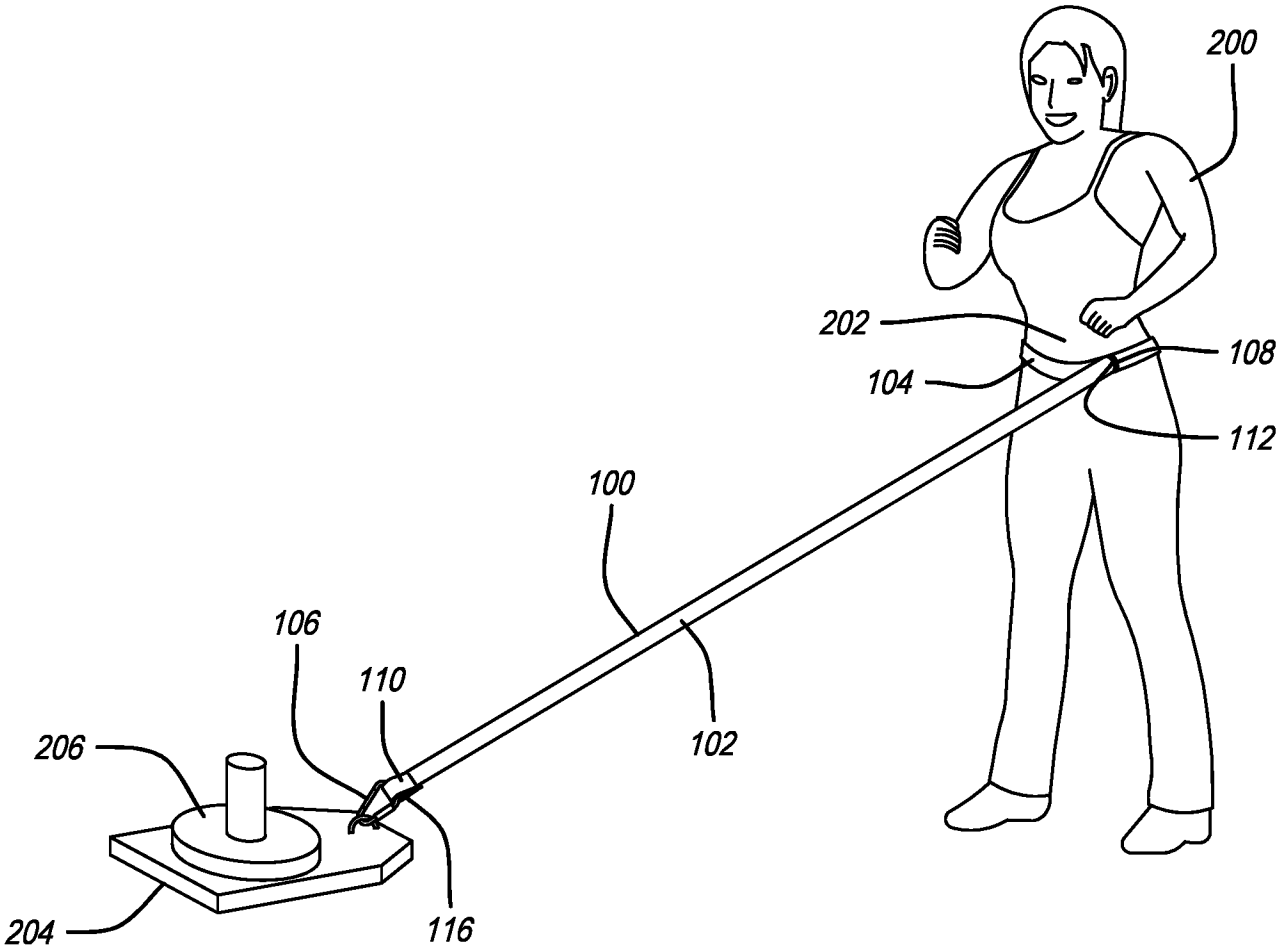
FIG. 3 is a system diagram of an example of an implementation of the waist mounted sled strap in use by a user in accordance with the present disclosure.

Turning to FIG. 3, a system diagram is shown of an example of an implementation of the waist mounted sled strap 100 in use by a user 200 in accordance with the present disclosure. In this example, the belt loop 104 is shown wrapped around the waist 202 of the user 200 and second end 110 is shown physically connected to the sled 204 via the carabiner 106 at the second opening 116. In this example, the sled 204 may be configured to support one or more weights 206 that will increase the overall mass of the sled 204 and increase the tensile force on the belt 104.

In operation, the user 200 utilizes the position of the first opening 112 to position the belt loop 104 on the waist 202 to best pull on the sled 204 and produce a physical work out. The user 200 be optionally facing the sled 204 to walk or run backwards and work the back muscles of the user's 200 legs and back or away from the sled 204 to work on the front muscles of the user's 200 legs and abdominal area.

From this figure, those of ordinary skill in the art appreciate that the waist mounted sled strap 100 is simple to use by the user 200 and has a low cost to manufacture. It allows a user 200 to step into the belt loop 104, attach the sled 204, and start his/her workout. It also allows for quickly putting on and taking off the waist mounted sled strap 100. There are no separate belts or parts to keep track of. As a single piece of hardware, it allows for easy storage and transport.

Figure 4:
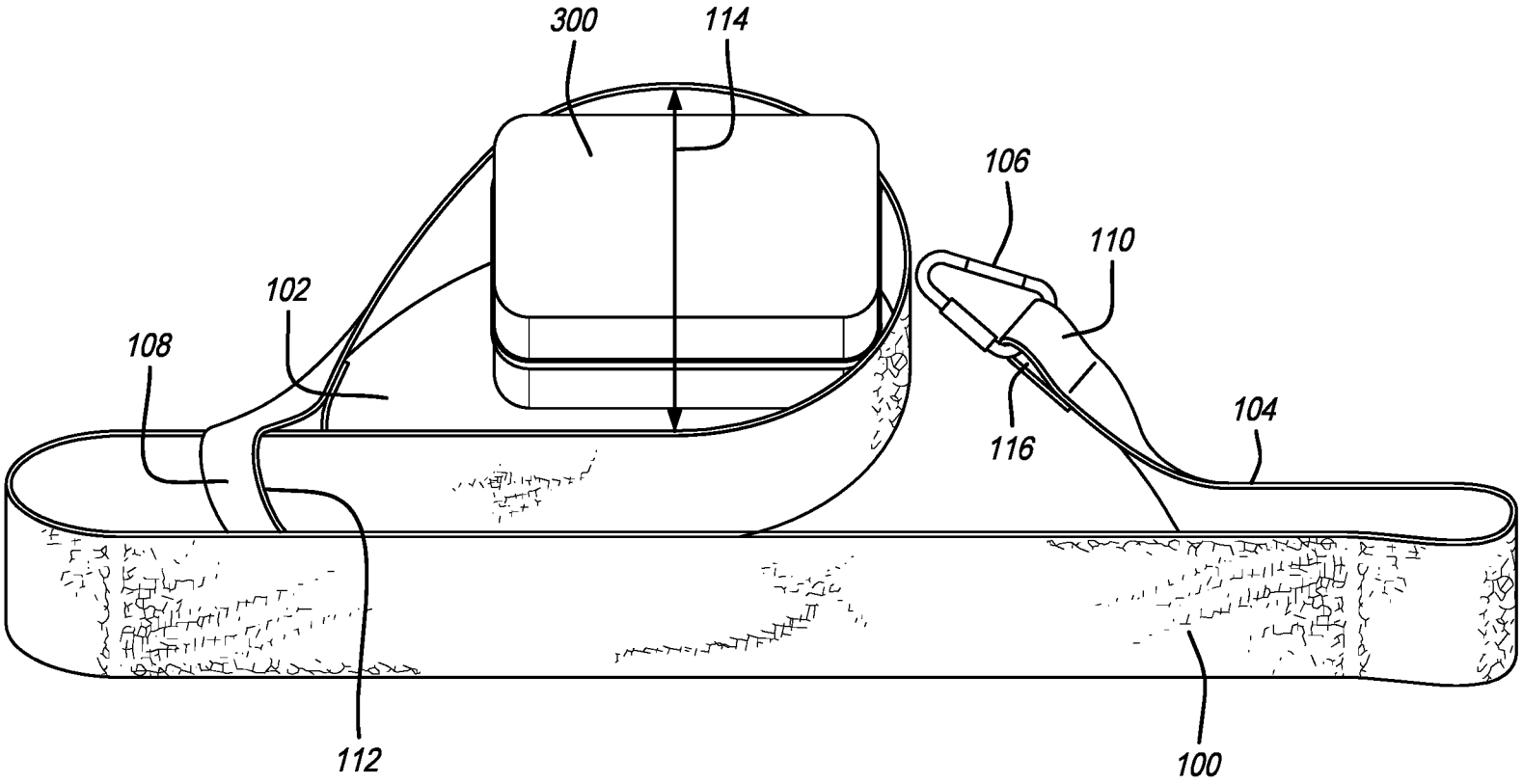
FIG. 4 is a top view of the waist mounted sled strap and storage case in accordance with the present disclosure.

In FIG. 4, a top view is shown of the waist mounted sled strap 100 and a storage case 300 in accordance with the present disclosure. As discussed earlier, the waist mounted sled strap 100 is a single piece of hardware that allows for easy storage and transport in the storage case 300.

Figure 5:
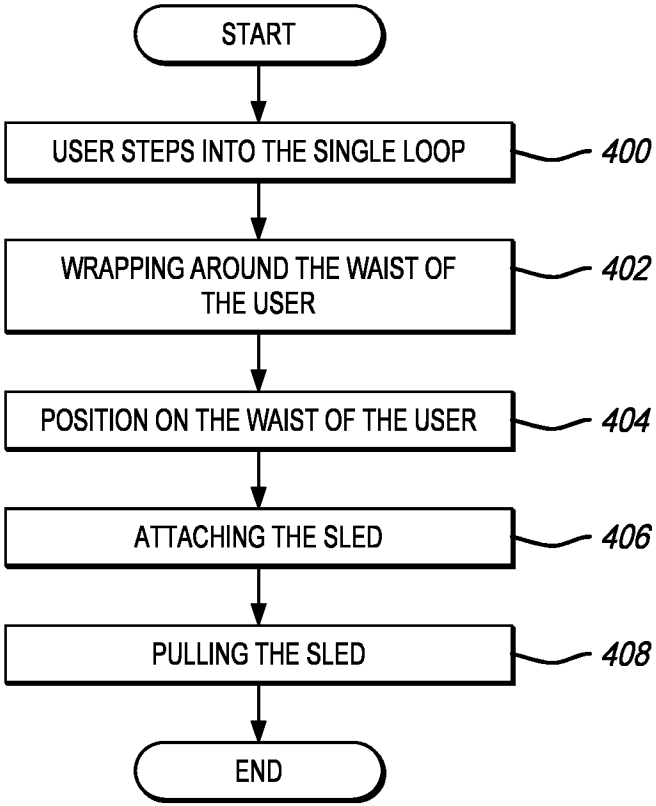
FIG. 5 is a flowchart illustrating steps of a method that utilizes the waist mounted sled strap in accordance with the present disclosure.

Turning to FIG. 5, a flowchart is shown illustrating the steps performed by a method that utilizes the waist mounted sled strap 100 in accordance with the present disclosure. In step 400, the user 200 steps into the belt loop 104 of the waist mounted sled strap 100. In step 402, the user 200 wraps the waist mounted sled strap 100 around the waist 202 of the user 200. In step 404, user 200 positions the first opening 112 in a position along the waist 202 of the user 200 that allows the user 200 to pull the sled 204. In step 406, the user attaches the waist mounted sled strap 100 to the sled 204 with the carabiner 106. In step 408, the user pulls the sled 204 with the waist mounted sled strap 100. The method then ends.

Figure 6:
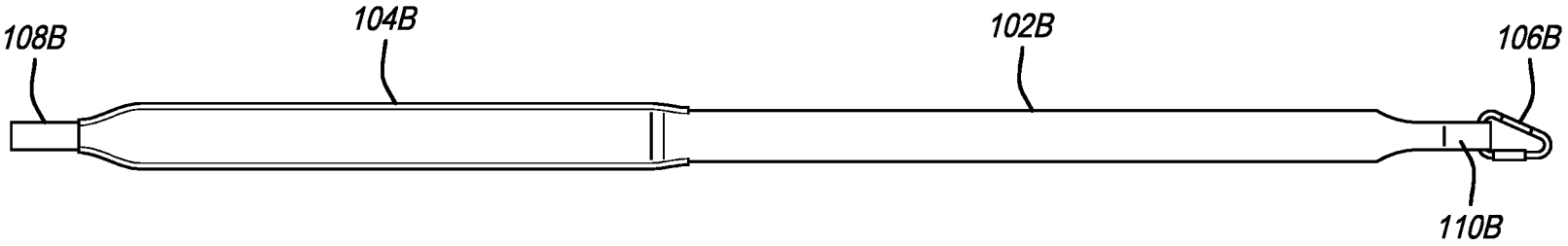
FIG. 6 is a top view of a further embodiment of the waist mounted sled strap having sections of varying width.

In some embodiments, it may be desirable for the width of strap 102 to vary along its length. FIG. 6 illustrates such an embodiment, wherein waist belt portion 104B is formed from a portion of the waist mounted sled strap that is greater in width than strap middle section 102B, thereby providing greater comfort for users during use. Ends 108B and 110B may be narrower in width than strap middle section 102B, facilitating e.g. mounting of carabiner 106B to end 110B and passage of the strap through end 108B to form a belt loop.

It will be understood that various aspects or details of the disclosure may be changed without departing from the scope of the disclosure. It is not exhaustive and does not limit the claimed disclosures to the precise form disclosed. Furthermore, the foregoing description is for the purpose of illustration only, and not for the purpose of limitation. Modifications and variations are possible in light of the above description or may be acquired from practicing the disclosure. The claims and their equivalents define the scope of the disclosure. Moreover, although the techniques have been described in language specific to structural features and/or methodological acts, it is to be understood that the appended claims are not necessarily limited to the features or acts described. Rather, the features and acts are described as an example implementations of such techniques.

Conditional language such as, among others, "can," "could," "might" or "may," unless specifically stated otherwise, are understood within the context to present that certain examples include, while other examples do not include, certain features, elements and/or steps. Thus, such conditional language is not generally intended to imply that certain features, elements and/or steps are in any way required for one or more examples or that one or more examples necessarily include logic for deciding, with or without user input or prompting, whether certain features, elements and/or steps are included or are to be performed in any particular example. Conjunctive language such as the phrase "at least one of X, Y or Z," unless specifically stated otherwise, is to be understood to present that an item, term, etc. may be either X, Y, or Z, or a combination thereof.

Furthermore, the description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

It will also be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A method for resistance training by pulling a sled with a waist mounted sled strap, the method comprising:

wrapping a waist mounted sled strap around the waist of a user, wherein the waist mounted sled strap comprises a strap formed from a single length of webbing, wherein the strap has a first end and a second end, wherein the single length of webbing has a continuous length from the first end to the second end, the first end has a first opening, the second end is passed through the first opening to form a belt loop that is wrapped around the waist of the user, and a carabiner that is physically connected to the strap at the second end of the strap, wherein the carabiner is configured to be physically connected to a sled;

positioning the belt loop in a position along the waist of the user that allows the user to pull the sled by adjusting a position of the first end along the strap;

attaching the carabiner to the sled; and pulling the sled with the waist mounted sled strap.

2. The method of claim 1, wherein:

the belt loop has an inner diameter; and wrapping the waist mounted sled strap around the waist of the user comprises tightening the waist mounted sled strap around the waist of the user by adjusting a position of the first end along the webbing to adjust the inner diameter of the belt loop.

3. The method of claim 2, wherein adjusting the inner diameter of the belt loop comprises moving the second end of the strap further from the first opening of the strap.

4. The method of claim 1, wherein attaching the carabiner includes passing the carabiner through a second opening at the second end of the strap.

5. The method of claim 1, wherein the continuous length of the single length of webbing has a length that enables the sled to be directly connected to the strap with the carabiner.

6. The method of claim 5, wherein the strap is formed from nylon webbing.

7. The method of claim 1, wherein the first opening has a length that is less than a width of the strap.

* * * * *